US008529216B2

(12) United States Patent
Briggs et al.

(10) Patent No.: US 8,529,216 B2
(45) Date of Patent: Sep. 10, 2013

(54) JET PUMP RETENTION AND SEAL METHOD WITH LIVING HINGE

(75) Inventors: Paul F. Briggs, Grand Blanc, MI (US); Jeffery John Milton, Lake Orion, MI (US); Matthias Nederegger, Rochester Hills, MI (US); John P. Wattai, Rochester Hills, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 1511 days.

(21) Appl. No.: 11/882,014

(22) Filed: Jul. 30, 2007

(65) Prior Publication Data

US 2009/0035153 A1 Feb. 5, 2009

(51) Int. Cl.
*F04B 23/08* (2006.01)

(52) U.S. Cl.
USPC ..... 417/87; 417/423.3; 417/151; 417/79; 417/80; 417/84; 277/560; 277/561

(58) Field of Classification Search
USPC ..... 417/87, 423.3, 151, 360, 423.15, 417/79, 80, 84, 88, 89; 123/509; 137/565.37, 137/565.22; 277/560, 561, 630, 637, 641
See application file for complete search history.

(56) References Cited

U.S. PATENT DOCUMENTS

| | | | | |
|---|---|---|---|---|
| 5,556,112 | A * | 9/1996 | Brandt | 277/560 |
| 5,649,711 | A * | 7/1997 | Jordan | 277/560 |
| 6,857,859 | B2 * | 2/2005 | Herbers et al. | 417/87 |
| 7,201,151 | B2 * | 4/2007 | Hayakawa | 123/509 |
| 2004/0161342 | A1 | 8/2004 | Herbers | |

FOREIGN PATENT DOCUMENTS

| | | | |
|---|---|---|---|
| EP | 1719657 | A | 11/2006 |
| WO | WO2005/053987 | A | 6/2005 |

OTHER PUBLICATIONS

Machine Translation of EP 1719657.*

* cited by examiner

*Primary Examiner* — Charles Freay
*Assistant Examiner* — Christopher Bobish

(57) ABSTRACT

A fuel supply unit includes a fuel reservoir (22) for holding fuel. A fuel pump (18) is in the reservoir for pumping fuel from the reservoir. A jet pump assembly (16) is within the reservoir for drawing fuel from a fuel tank into the reservoir. A seal structure (24) has a flange (28) with a living hinge (31). The seal structure is operatively coupled with a housing of the jet pump assembly and disposed between the housing and a portion of the reservoir, with a portion of the flange being pivoted about the living hinge such that the portion of the flange engages an interior surface of the reservoir, providing a seal between the housing of the jet pump assembly and the interior surface of the reservoir.

16 Claims, 2 Drawing Sheets

JET PUMP RETENTION AND SEAL METHOD WITH LIVING HINGE

FIELD OF THE INVENTION

The invention relates to fuel supply units for automobile vehicles and more particularly, to a jet pump assembly of a fuel supply unit that includes a seal to reduce noise in a fuel tank and to improve performance of the jet pump assembly.

BACKGROUND OF THE INVENTION

One type of a conventional fuel pump unit for supplying fuel in a vehicle includes a fuel pump disposed within a swirl pot or fuel reservoir. The reservoir is disposed near a bottom of a fuel tank. The fuel pump pumps fuel from the reservoir through a fuel filter to an engine. A pressure regulator is coupled to the filter housing and returns excess fuel to the reservoir. The fuel pump also operates a jet pump assembly that draws fuel into the reservoir to ensure that the reservoir is replenished with fuel. A housing of the jet pump assembly is typically in plastic-to-plastic contact with the bottom of the reservoir that transmits noise when the jet pump assembly is operating to replenish the reservoir with fuel. In addition, the housing-reservoir interface defines a tortuous path for fuel so that fuel is drawn substantially directly from the fuel tank.

Accordingly, there is a need to provide a seal structure to decoupled the jet pump assembly from the reservoir to reduce noise of the fuel pump unit and to improve the performance of the jet pump assembly.

SUMMARY OF THE INVENTION

An object of the invention is to fulfill the need referred to above. In accordance with the principles of the present invention, this objective is achieved by providing a fuel supply unit that includes a fuel reservoir for holding fuel. A fuel pump is in the reservoir for pumping fuel from the reservoir. A jet pump assembly is within the reservoir for drawing fuel from a fuel tank into the reservoir. A seal structure has a flange with a living hinge. The seal structure is operatively coupled with a housing of the jet pump assembly and disposed between the housing and a portion of the reservoir, with a portion of the flange being pivoted about the living hinge such that the portion of the flange engages an interior surface of the reservoir, providing a seal between the housing of the jet pump assembly and the interior surface of the reservoir.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
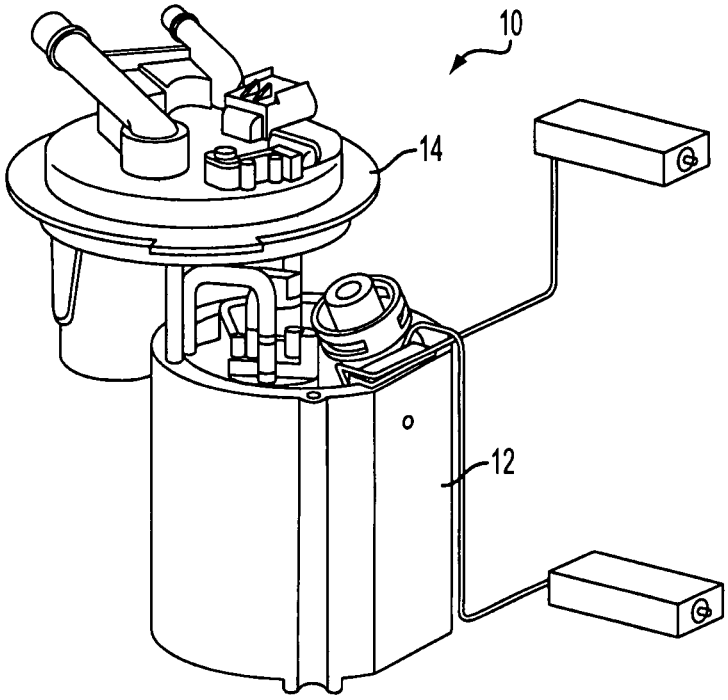
FIG. 1 is a perspective view of a fuel supply unit having a jet pump assembly provided in accordance with an embodiment of the present invention.

With reference to FIG. 1, a fuel supply unit, provided in accordance with an embodiment of the invention, is shown generally indicated at 10. The unit includes a fuel pump and reservoir assembly 12 and a filter/regulator assembly 14 that receives fuel supplied by the assembly 12 and delivers the fuel to an engine.

Figure 2:
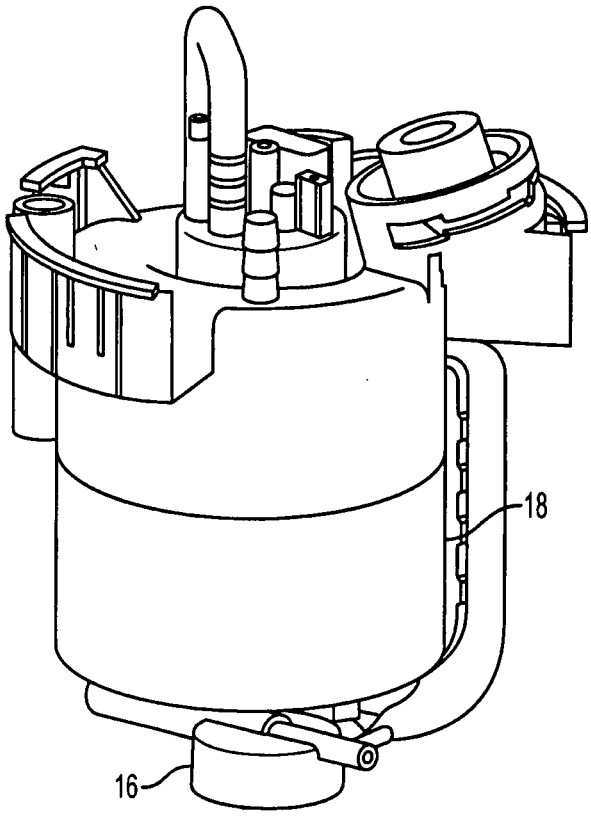
FIG. 2 is a perspective view of a fuel pump of a jet pump assembly of the fuel supply unit of FIG. 1.
Figure 3:
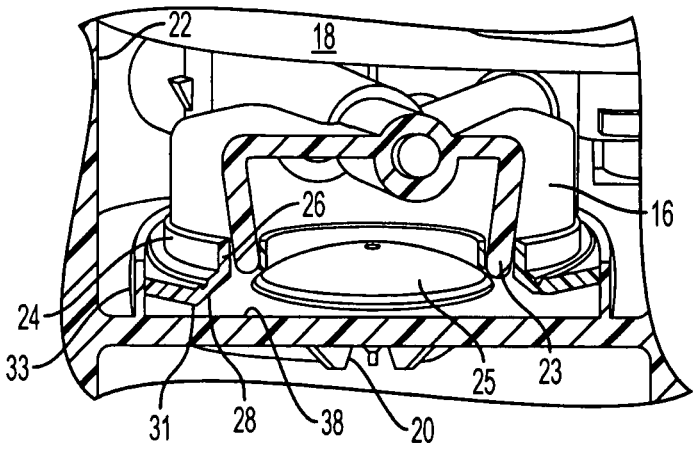
FIG. 3 is a partial sectional view of a seal structure shown between a housing of the jet pump assembly and the reservoir in accordance with an embodiment of the invention.

As shown in FIGS. 2 and 3, the assembly 12 includes a fuel pump 18 and conventional jet pump assembly 16 configured to draw fuel from a fuel tank (not shown) through an opening 20 of the reservoir 22 to replenish fuel in the reservoir 22 so as to be pumped to an engine (not shown). A valve 25 is associated with the opening 20.

As shown in FIG. 3, in accordance with an embodiment of the invention, a seal structure 24 is provided between a housing 23 of the jet pump 16 and a portion of the reservoir 22 so as to decouple the jet pump 16 from the reservoir 22 and to provide a seal between the jet pump housing 23 and the reservoir 22.

Figure 4:
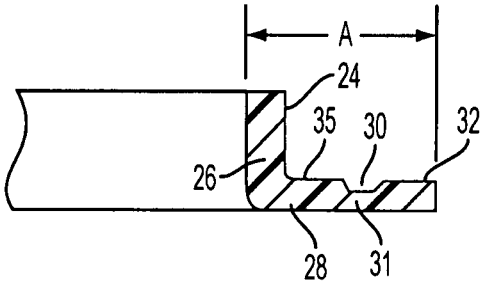
FIG. 4 is a partial sectional view of the seal structure of FIG. 3.
Figure 5:
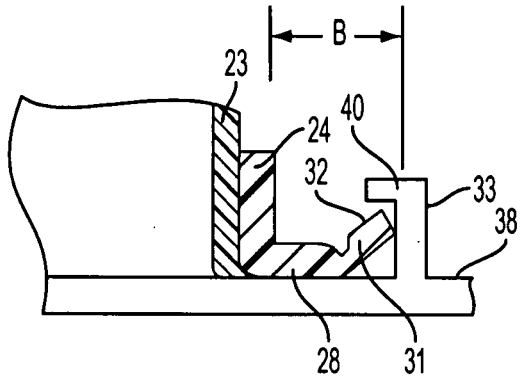
FIG. 5 is a view of the seal structure of claim 4 shown coupled with a housing of the jet pump assembly and engaged with a portion of the reservoir.
Figure 6:
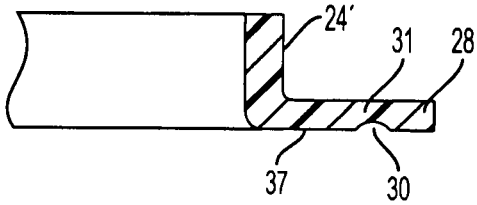
FIG. 6 is a partial sectional view of another embodiment of the seal structure.

In the embodiment of FIGS. 3-5, the seal structure 24 is preferably an elastomer having a generally cylindrical engaging portion 26 constructed and arranged to frictionally engage an outer periphery of the generally cylindrical jet pump housing 23. As best seen in FIG. 4, an annular flange 28 extends from the engaging portion 26. The flange 28 includes surfaces defining an annular extending cut-out 30 between an end portion 32 and engaging portion 26 of the seal structure 24. The cut-out 30 defines a living hinge 31 such that such that the free end portion 32 of the flange 28 can pivot. Although the cut-out 30 is shown in the upper surface 35 of the flange 28, it can be provided on the under surface 37 of the flange 28 of the seal structure 24' as shown in FIG. 6.

With reference to FIGS. 3 and 5, the reservoir 22 includes an annular wall 36 extending from the bottom 38 thereof. When assembled, the free end portion 32 of the flange 28 pivots about the living hinge 31 so as to engage the annular wall 33 or interior surface of the reservoir 22 and thus provides a seal between the reservoir and the jet pump housing 23. It has been determined that the efficiency of the jet pump assembly 16 is improved due to sealing between the jet pump housing 23 and the reservoir 22 since fuel is drawn directly from the fuel tank. The annular wall 32 can include a portion 40 (FIG. 5) that extends radially towards the engaging portion 26 so as to capture the end 32 of the seal structure 24 and thus contain the jet pump housing 23 in the reservoir 22.

With reference to FIGS. 4 and 5, the distance B is always less than the distance A within a controlled range. This ensures that the jet pump housing 23 is press-fit into the reservoir 22 in the area of the seal structure 24, creating a tight seal. The seal structure 24 is of a material that can be exposed to fuel, such as VITON®. The seal structure 24 is preferably coupled with the jet pump housing 23 in a friction-fit arrangement, but can be overmolded onto the housing 23. However, since the friction engagement or overmolding require an additional process, the seal structure 24 can be molded as an integral part of the housing 23 in a single molding process. For example, at the time of molding the housing 23, preferably out of POM material, the seal structure 24 can be defined in the mold and molded from the POM material as well.

Thus, the seal structure 24 mechanically decouples the jet pump 16 from the bottom of the reservoir 22 to aid in noise reduction when the jet pump operates and provides a seal between the bottom of the reservoir 22 and the jet pump housing, allowing suction of fuel directly from the fuel tank. The seal structure 24 also allows for tolerance stack variations.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel supply unit comprising:

a fuel reservoir for holding fuel, a fuel pump within the reservoir for pumping fuel from the reservoir, a jet pump assembly within the reservoir for drawing fuel from a fuel tank into the reservoir, and seal structure having a flange with a living hinge, the seal structure being operatively coupled with a housing of the jet pump assembly and disposed between the housing and a portion of the reservoir, with a portion of the flange being pivoted about the living hinge such that the portion of the flange engages an annular wall of the reservoir, providing a seal between the housing of the jet pump assembly and the annular wall of the reservoir, wherein the flange is annular having a generally constant thickness and the living hinge is defined by an annular extending cut-out in the annular flange between the free end portion and the engaging portion, with the cut-out defining the living hinge to have a thickness less that the generally constant thickness.

2. The fuel supply unit of claim 1, wherein an outer periphery of the housing of the jet pump assembly is generally cylindrical and the seal structure has a generally cylindrical engaging portion frictionally engaging the outer periphery of the housing.

3. The fuel supply unit of claim 2, wherein the flange extends from the engaging portion with a free end portion of the flange defining the portion engaging the interior surface of the reservoir.

4. The fuel supply unit of claim 1, wherein the annular extending cut-out is provided in an upper surface of the flange.

5. The fuel supply unit of claim 1, wherein the annular extending cut-out is provided in an under surface of the flange.

6. The fuel supply unit of claim 1, wherein the seal structure is an elastomer.

7. The fuel supply unit of claim 1, wherein the annular wall includes a portion that extends radially towards the engaging portion to capture at least a portion of the seal structure.

8. The fuel supply unit of claim 1, wherein the seal structure and the housing are integral, molded components.

9. A fuel supply unit comprising:

means for holding fuel, means for pumping fuel from the means for holding fuel, means for drawing fuel from a fuel tank into the means for holding fuel, and seal structure having a flange and means for permitting pivoting of a portion of the flange, the seal structure being operatively coupled with a housing of the means for drawing fuel and disposed between the housing and a portion of the means for holding fuel, with a portion of the flange being pivoted about the means for permitting pivoting such that the portion of the flange engages an annular wall of the means for holding fuel, providing a seal between the housing and the annular wall, wherein the flange is annular having a generally constant thickness and the means for pivoting is defined by an annular extending cut-out in the annular flange between the free end portion and the engaging portion, with the cut-out defining the means for pivoting to have a thickness less that the generally constant thickness.

10. The fuel supply unit of claim 9, wherein the means for drawing fuel is a jet pump assembly and an outer periphery of the housing is generally cylindrical and the seal structure has a generally cylindrical engaging portion frictionally engaging the outer periphery of the housing.

11. The fuel supply unit of claim 10, wherein the flange extends from the engaging portion with a free end portion of the flange defining the portion engaging the interior surface of the means for holding fuel.

12. The fuel supply unit of claim 9, wherein the annular extending cut-out is provided in an upper surface of the flange.

13. The fuel supply unit of claim 9, wherein the annular extending cut-out is provided in an under surface of the flange.

14. The fuel supply unit of claim 9, wherein the seal structure is an elastomer.

15. The fuel supply unit of claim 9, wherein the annular wall includes a portion that extends radially towards the engaging portion to capture at least a portion of the seal structure.

16. The fuel supply unit of claim 9, wherein the seal structure and the housing are integral, molded components.

* * * * *